US006854867B2

(12) United States Patent
Más Quiles et al.

(10) Patent No.: US 6,854,867 B2
(45) Date of Patent: Feb. 15, 2005

(54) CHANDELIER

(76) Inventors: Emilio Más Quiles, Lámparas Gendes, Inc., 525 Andalucía Ave., Puerto Nuevo, San Juan, PR (US) 00920; Francisco Gendes, Lámparas Gendes, Inc., 525 Andalucía Ave., Puerto Nuevo, San Juan, PR (US) 00920

( * ) Notice: Subject to any disclaimer, the term of this patent is extended or adjusted under 35 U.S.C. 154(b) by 135 days.

(21) Appl. No.: 10/318,976

(22) Filed: Dec. 12, 2002

(65) Prior Publication Data

US 2004/0114377 A1 Jun. 17, 2004

(51) Int. Cl.[7] ..... F21S 8/06

(52) U.S. Cl. ..... 362/405; 362/147; 362/225; 362/221; 362/249; 362/370; 362/391; 362/457; 362/806; 439/675

(58) Field of Search ..... 362/405, 147, 362/225, 221, 220, 249, 370, 391, 431, 457, 806; 439/313, 210, 675, 322

(56) References Cited

U.S. PATENT DOCUMENTS

| | | | | | |
|---|---|---|---|---|---|
| 349,809 | A | * | 9/1886 | Perkins | 439/313 |
| 4,502,748 | A | * | 3/1985 | Brush et al. | 439/313 |
| 5,385,482 | A | * | 1/1995 | Rottner | 439/409 |
| 6,565,240 | B1 | * | 5/2003 | Wu | 362/405 |
| 2004/0022062 | A1 | * | 2/2004 | Wu | 362/405 |

* cited by examiner

*Primary Examiner*—Stephen Husar
*Assistant Examiner*—Sharon Payne
(74) *Attorney, Agent, or Firm*—Patent Law Offices of Heath W. Hoglund

(57) ABSTRACT

A chandelier includes a central support member that extends from a ceiling support to a distributor plate. A number of removable arms connected to the distributor plate. An electrical connection is made from the central support to the arms at the distributor plate. The electrical connection is completed and broken as the arms are connected and removed from the distributor plate.

18 Claims, 18 Drawing Sheets

CHANDELIER

FIELD OF THE INVENTION

The invention relates generally to the art of chandelier manufacturing and more specifically to an improved method of making an electrical and mechanical connection between the body and the arms of a chandelier.

BACKGROUND OF THE INVENTION

The art of chandelier manufacturing dates back centuries. It has evolved from the manufacturing of candelabras and was revolutionized by the invention of the light bulb. Today, many chandeliers are mass manufactured and delivered fully assembled or completely dismantled depending on its size and difficulty to reassemble.

A typical design is shown in FIG. 1. It includes a central support member 100 that extends from a ceiling support to a distributor plate 102. The upper portion of the central support member 100 is made of a chain 104. A lower portion of the central support member 100 is made of a tube 106. In between the chain 104 and the tube 106, a number of decorative elements are used both to enhance the appearance of the central support member 100 and to provide support for the distributor plate 102.

The distributor plate 102 is composed of a metal disc. It has a hole in its center that is used to connect to tube 106. It has a plurality of holes about its perimeter that are used to attach to arms 108. Specifically, an inner end of arms 108 extends through the perimeter holes of distributor plate 102 and attaches thereto. An outer end of arms 110 each supports a lamp socket 110.

Electricity is supplied to the lamp socket 110 from the top of the central support member 100. Specifically, electrical wires are threaded through chain 104, through any intermediate elements and through tube 106. Likewise, electrical wires from the lamp socket 110 are threaded through arms 108. Twist-type electrical connectors 112 commonly are used to complete the path between the wires running through the central support member 100 and the wires running through the arms 108.

For elaborate chandeliers, due in part to their size, the final assembly is made at installation. In other words, these chandeliers are shipped in pieces; the arms 108 are shipped disconnected from distributor plate 102. At installation, the arms 108 are attached and the necessary electrical connections are made. The distributor plate 102 with its plurality of connections are then covered with decorative elements to conceal their unsightliness. This is a time consuming process, usually performed on a scaffold, and depending upon local regulations, may require the employment of a licensed electrician.

In addition, arms 108 may be made of glass or other breakable materials. In the event that an arm 108 is damaged or must be removed for any reason, the decorative elements covering the distributor plate 102 must be removed and the electrical and mechanical connection must be undone. For a large chandelier with many arms and decorative elements, disassembly is often time consuming and involves the return of scaffolding, and the employment of a licensed electrician.

FIG. 2 illustrates a schematic of a typical two-tiered chandelier design with a center support 200, a top distributor plate 202 and a bottom distributor 204. Many large chandeliers have two or more distributor plates. Each has to be assembled with its plurality of arms, and then covered with decorative elements before the next distributor is added. If any of the upper arms are damaged disassembly could result in a project as large as the initial installation of the chandelier.

SUMMARY OF THE INVENTION

To overcome these difficulties, an improved arm connection provides electrical terminations that complete and disconnect the electrical path as the arm is attached and removed, respectively.

According to one aspect of the invention, a chandelier includes a distributor plate, connections, arms, pairs of wires and light-bulb sockets. The connections extend through the distributor plate. Each of the connections includes a pair of electrical terminations. The arms each removeably attach to one of connections. Each of the arms includes a pair of electrical terminations. When the arms are attached to the connections, the pair of electric terminations of the arms connects with the electrical terminations of the connections. The pairs of wires each extend through one of the arms and connect with the electrical terminations of the arms. The light-bulb sockets attached to the arms and electrically connect with the pairs of wires.

According to further aspects of the invention, the distributor plate is made of a metal disc. The connections are evenly spaced about the perimeter of the metal disc. The connections each define a circular flange extending there from. The circular flange joins the connections to the metal disc. One side of the circular flange is notched so that when the connections are positioned about the perimeter of the metal disc, the notch is positioned nearest the circumference of the metal disc so that the circular flange does not extend past the metal disc. The connections each include a cylinder extending through the distributor plate. A first end of the cylinder is substantially hollow so that it may receive one of the arms. The electrical terminations of the connections are positioned at the base of the hollow portion of the cylinders. An exterior end of the cylinder is threaded. The arms each include a circular rib fixedly joined to the arm and a rotatable ring positioned over the circular rib. An interior surface of the rotatable ring is threaded. The rotatable ring defines an inner aperture having a diameter smaller than the circular rib. When the arms are positioned in the connections, the threaded interior surface of the rotatable ring engages the threaded exterior end of the cylinder; the inner aperture of the rotatable ring presses against the circular rib. The exterior of the rotatable ring defines a plurality of holes evenly distributed about its circumference to receive a pair of tool prongs used to tighten the engagement of the rotatable ring with the threaded exterior end of the cylinder. The pair of electrical terminations of the connections includes an insulator disc with a first terminal substantially centered on the insulator disc and a second circular terminal substantially concentric with the insulator disc. Each of the pair of electrical terminations of the plurality of arms comprises a first and a second prong spaced to match the radial distance between the first terminal and second circular terminal.

According to a further aspect of the invention, the connection comprises a cylinder extending from the distributor plate. The arm comprises a hollow cavity configured to receive the cylinder and a set screw configured to attach the arms to the connections.

According to another aspect of the invention, a chandelier includes a central support member, a first plate, a first plurality of sockets and a first plurality of arms. The central support member extends substantially from a top to a bottom of the chandelier. The first plate attaches to and is supported by the central member. The first plurality of sockets attach to the first plate. The first plurality of sockets includes an electrical connection. The first plurality of arms each has an electrical connection. Each one of the first plurality of arms is removeably attached to a respective one of the first plurality of sockets. When the first plurality of arms is attached to the first plurality of sockets the electrical connections of the first plurality of arms complete an electrical path with the electrical connections of the first plurality of sockets. When the first plurality of arms is removed from the first plurality of sockets the electrical connections of the first plurality of arms breaks the electrical path with the electrical connections of the first plurality of sockets.

According to further aspects of the invention, the central support member comprises an upper chain connected with a lower tube. The lower tube attaches to the center of the first plate. The first plate comprises a metal disc. The first plurality of sockets each comprises a cylinder extending through the first plate. At least a portion of the cylinder defines a chamber suitable to receive an end of one of the first plurality of arms. The electrical connections of the first plurality of sockets each include a first insulator disc and a first and a second terminal. The first terminal is positioned at the center of the first insulator disc and the second terminal extends along a radial path of the first insulator disc. The electrical connections of the first plurality of arms each include a second insulator disc and a third and a fourth terminal. The third terminal is positioned at the center of the second insulator disc. The fourth terminal extends along a radial path of the second insulator disc. The fourth terminal has substantially the same circumference as the second terminal. The chandelier further includes a first plurality of light bulb sockets each one attached to one of the plurality of arms and electrically connected with a respective one of the electrical connections of the plurality of arms.

According to further aspects of the invention, the chandelier also includes a second plate, a second plurality of sockets and a second plurality of arms. The second plate attaches to and is supported by the central member below the first plate. The second plurality of sockets attached to the second plate. Each of the second plurality of sockets includes an electrical connection. The second plurality of arms each have an electrical connection. Each of the second plurality of arms is removeably attached to a respective one of the second plurality of sockets. When the second plurality of arms is attached to the second plurality of sockets the electrical connections of the second plurality of arms complete an electrical path with the electrical connections of the second plurality of sockets. When the second plurality of arms is removed from the second plurality of sockets the electrical connections of the second plurality of arms breaks the electrical path with the electrical connections of the second plurality of sockets.

According to another aspect of the invention, a light fixture includes a body, connections, arms, light bulb sockets and electrical paths. The connections attach to the body. The arms each removeably couple with one of the connections. The light bulb sockets each connected with one of the arms. The electrical paths begin in the body, extending through the connections, through the arms and connect with the light bulb sockets. The electrical paths include an electric connection at the arm connections. The electrical path from the body to the light bulb socket is completed when the arms are joined to the arm connections. The electric path from the body to the light bulb socket is broken when the arms are removed from the arm connections.

DETAILED DESCRIPTION OF THE INVENTION

Figure 1:
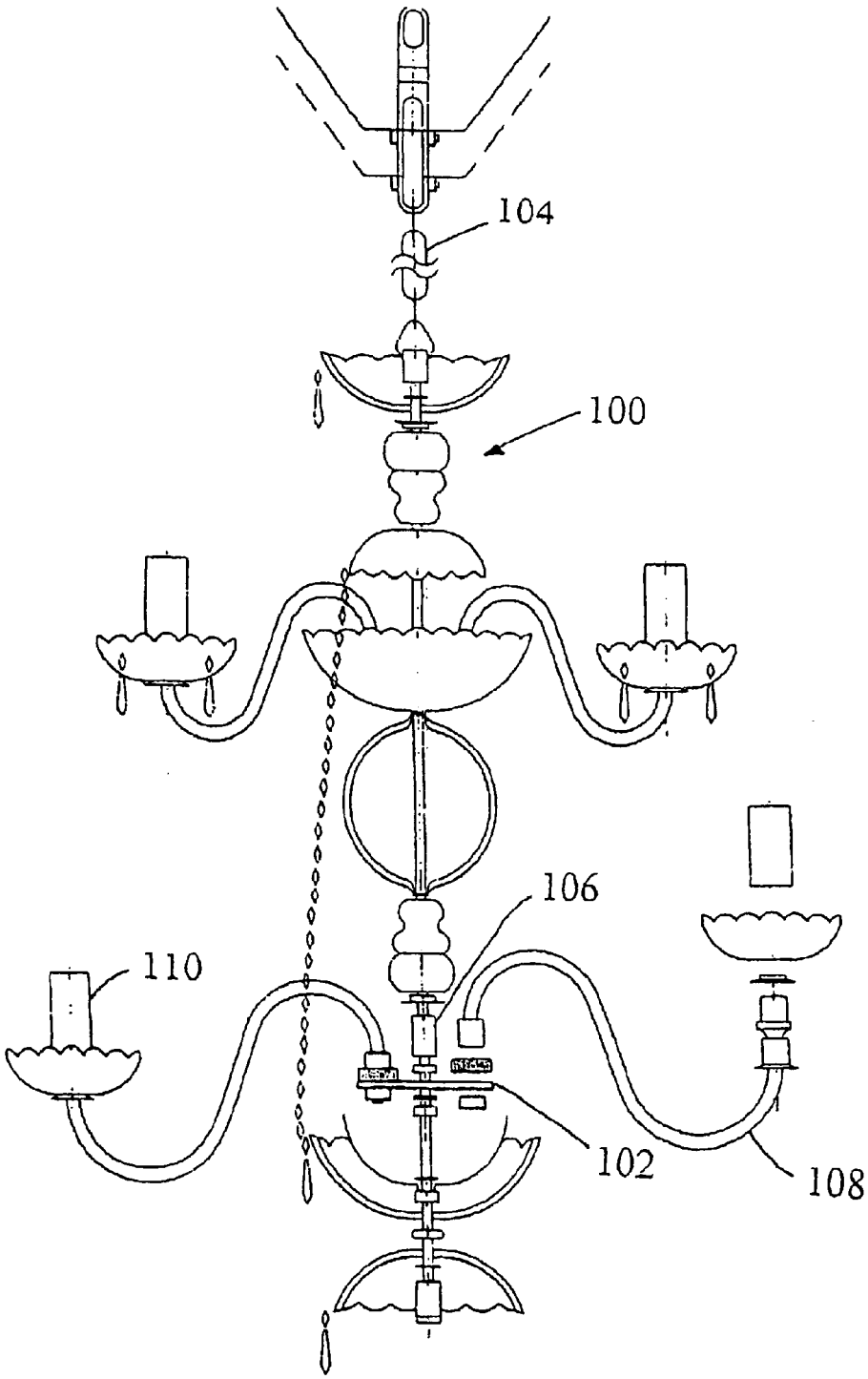
Fig. 1 (Prior Art)
FIG. 1 is a side view, partially exploded, of a prior art chandelier.
Figure 2:
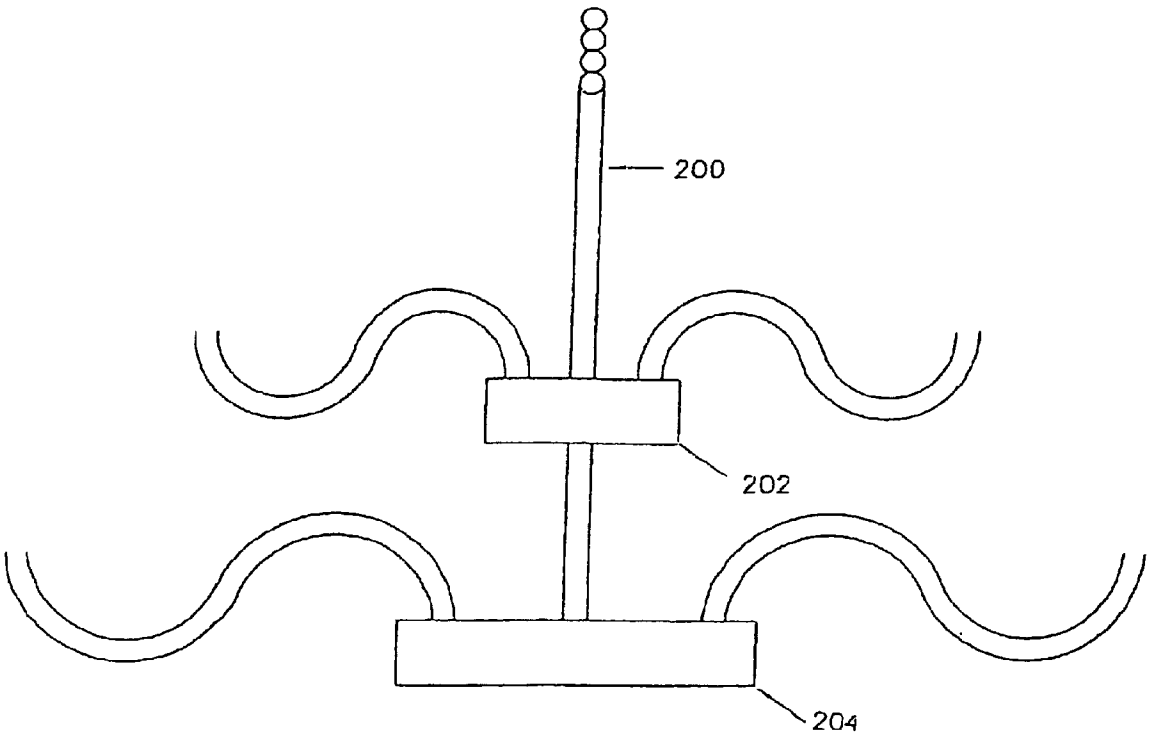
FIG. 2 (Prior Art)
FIG. 2 is a side view of a prior-art two-tiered chandelier.

According to one preferred embodiment of the invention, a distributor plate 302 is made of an aluminum disc. The distributor plate 302 defines a plurality of holes 304 evenly spaced about its circumference. An arm connector 306 is attached to the distributor plate 302 at each hole by a hollow threaded rod 308. More specifically, arm connector 306 defines a lower threaded hole 310 that engages the threaded rod 308. The treaded rod 308 passes through one of the holes 304 in distributor plate 302, then through a washer 312, then through a nut 314. The arm connector 306 is tightened on opposite sides of the distributor plate 302 against nut 314. This secures the connector 306 to the distributor plate 302.

Wires 316 and 318 pass through the threaded rod 308 and terminate at electrical connector 320. Wire 316 joins with a center terminal and wire 318 joins with a radial terminal described below with reference to FIG. 3C.

Figure 3A:
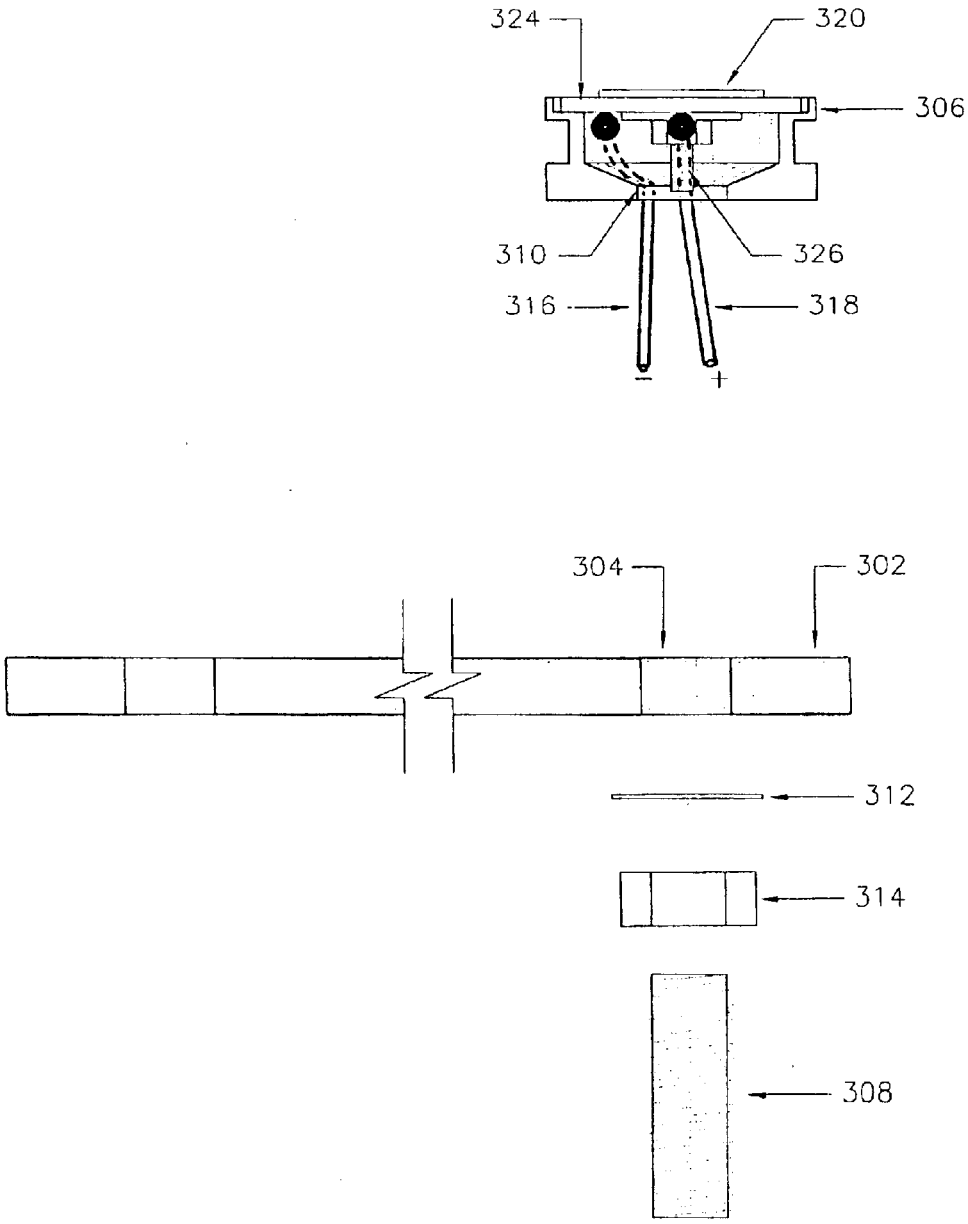
FIG. 3A is a cross-sectional side view, partially exploded of one preferred arm connection from a chandelier distributor plate.
Figure 3B:
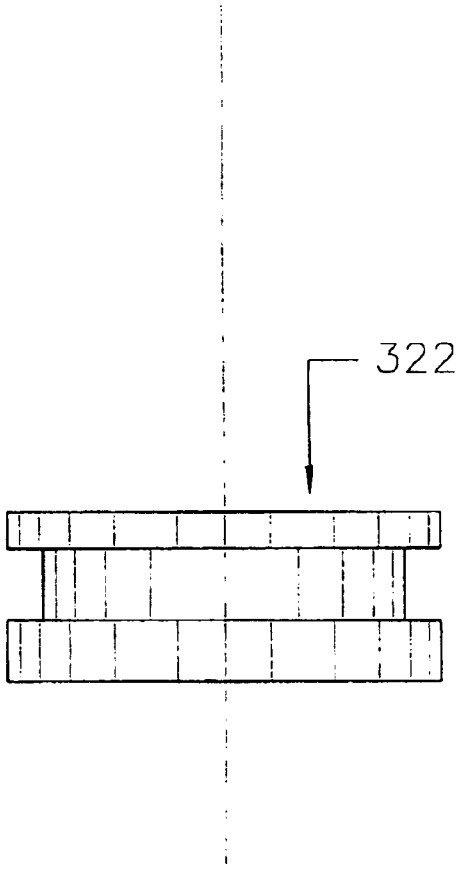
FIG. 3B is a side view of the arm connection of FIG. 3A.

Turning to FIG. 3B, a side view of arm connector 306 is shown. The exterior of arm connector 306 is a short cylinder. The side wall of this cylinder defines a recessed channel. This is used to form a secure connection with the arm socket described below with reference to FIG. 4A.

Figure 3C:
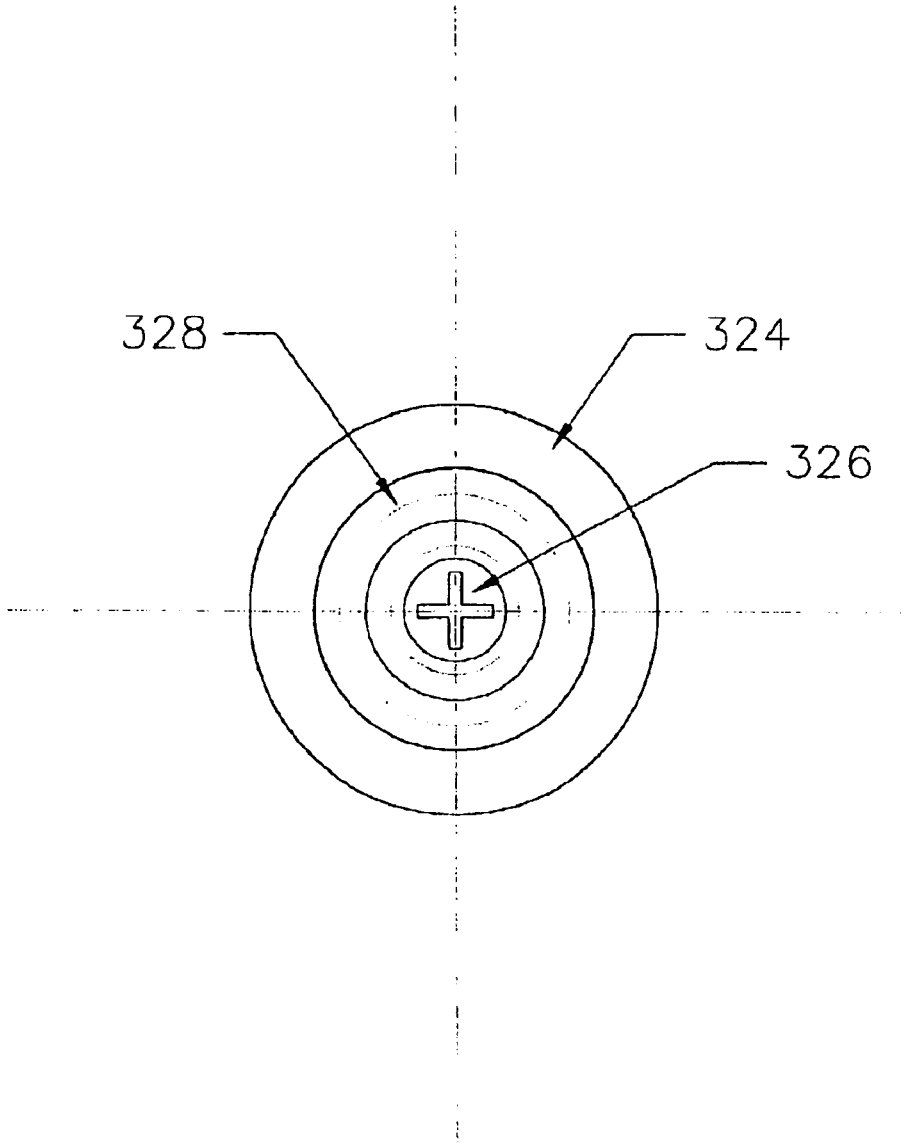
FIG. 3C is a top view of the electric terminals of the arm connection of FIG. 3A.

Turning to FIG. 3C, the electrical connector 320 is further described. It includes a disc-shaped insulator 324. One electric terminal is made at the center of the terminal by screw 326. The other electric terminal is made by an annular ring 328, that is concentric with the disc-shaped insulator 324.

Figure 4A:
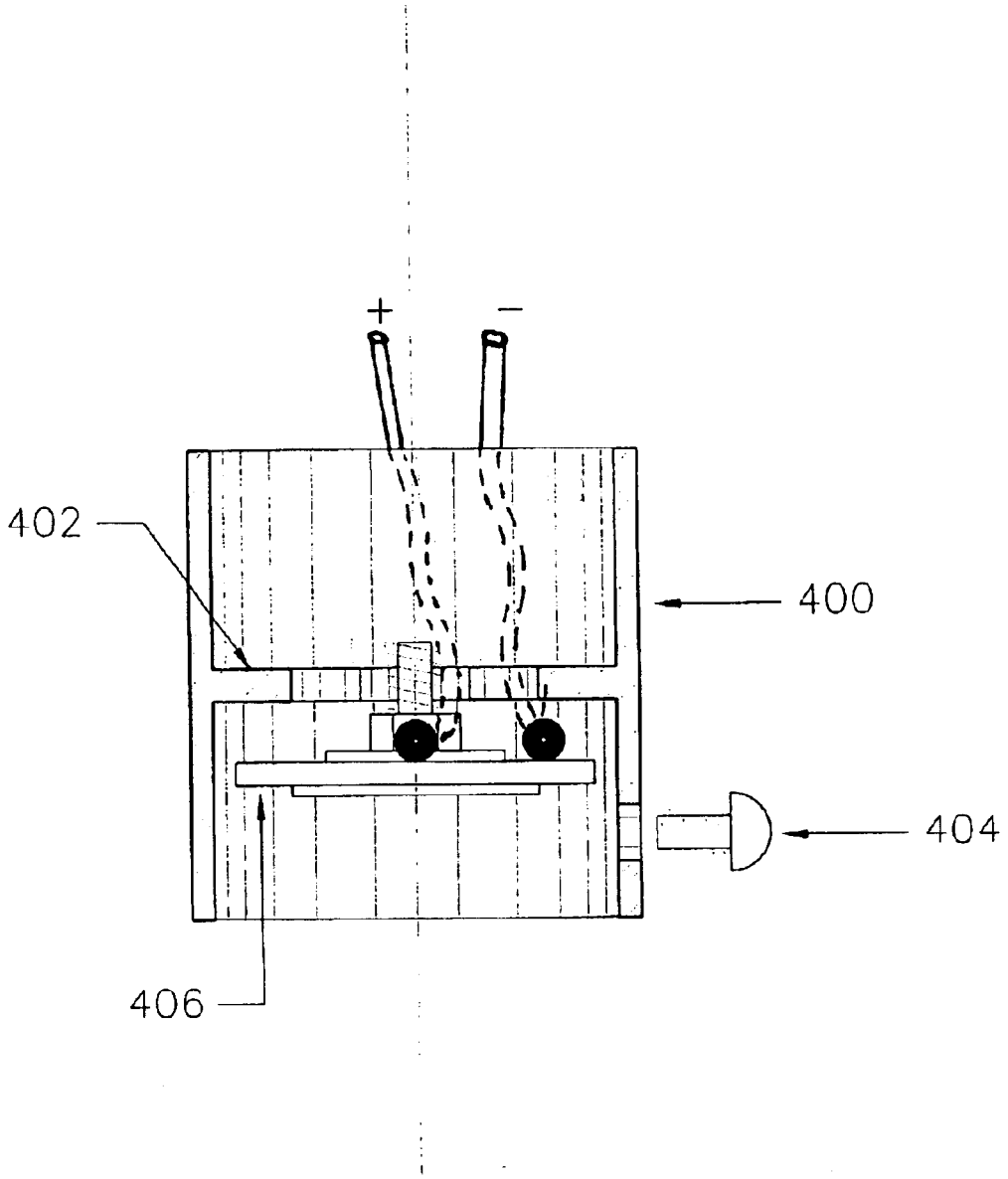
FIG. 4A is an cross-sectional side view of an arm socket used to join with the arm connection of FIG. 3A.
Figure 4B:
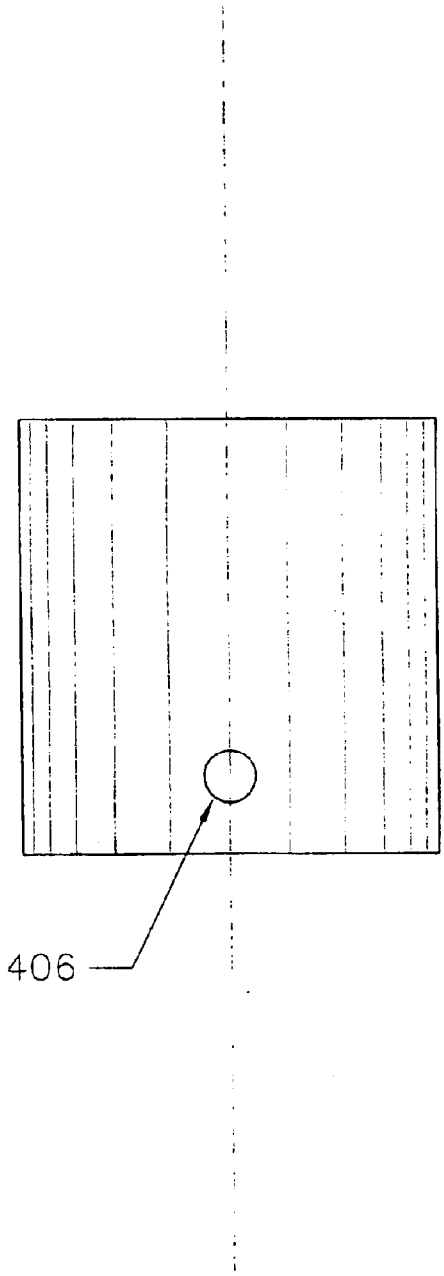
FIG. 4B is a side view of the arm socket of FIG. 4A.
Figure 4C:
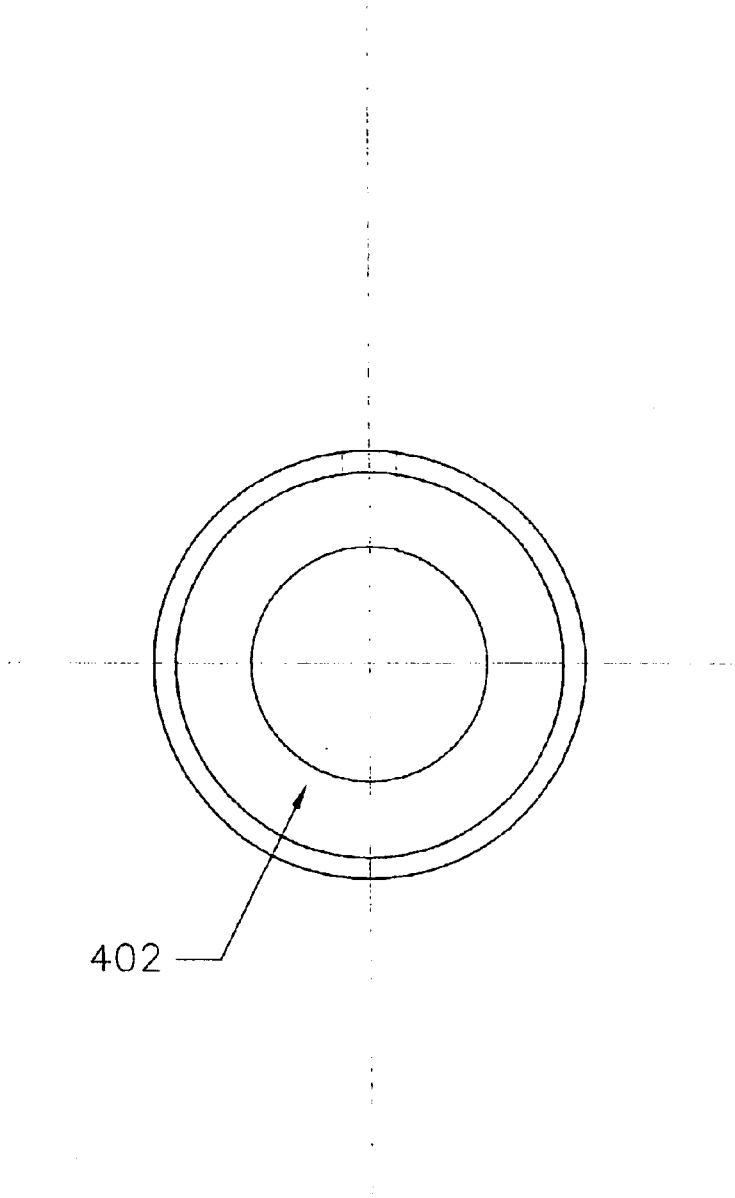
FIG. 4C is a top view of the arm socket of FIG. 4A.

Turning to FIG. 4A, an arm socket 400 used to mate with arm connector 306 is described. The arm socket 400 is substantially formed as a hollow cylinder with an interior ring 402 (also shown in FIG. 4C) extending across its middle. The interior ring separates the interior into an upper and a lower cavity. The upper cavity receives and is bonded to a hollow chandelier arm. The lower cavity receives and mates with the arm connector 306. At least one side screw 404 is turned through a threaded hole (shown in FIG. 4A) to engage channel 322.

A second electrical connection 406 is positioned just below ring 402. Electrical connection 406 has the same design as connector 320. When the arm socket 400 is placed upon the arm connector 306, these matching connectors complete an electrical path between the main body of the chandelier and the light sockets at the outer ends of the arms.

Figure 5A:
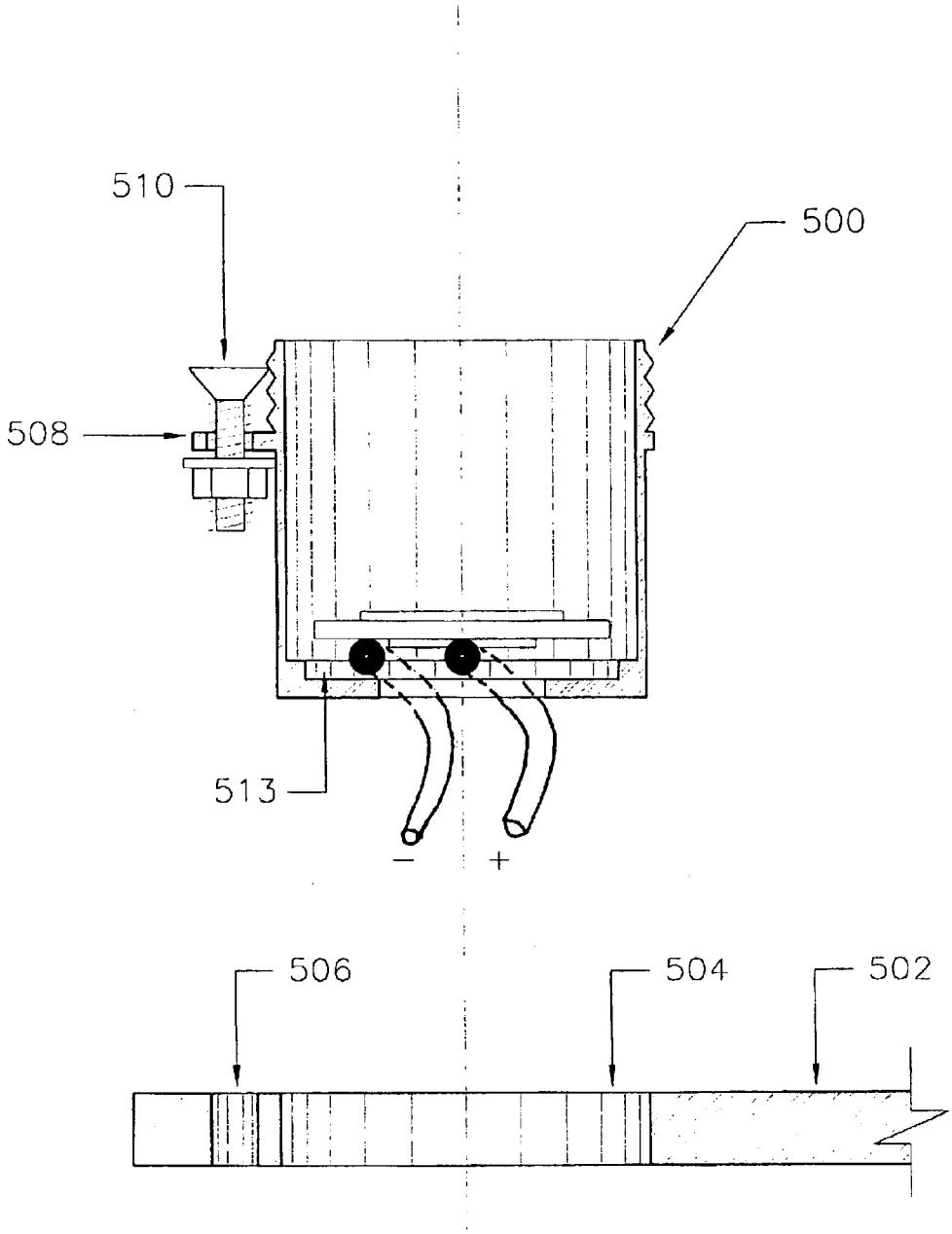
FIG. 5A is a cross-sectional side view of another preferred arm socket used to connect a chandelier arm to a distributor plate.
Figure 5B:
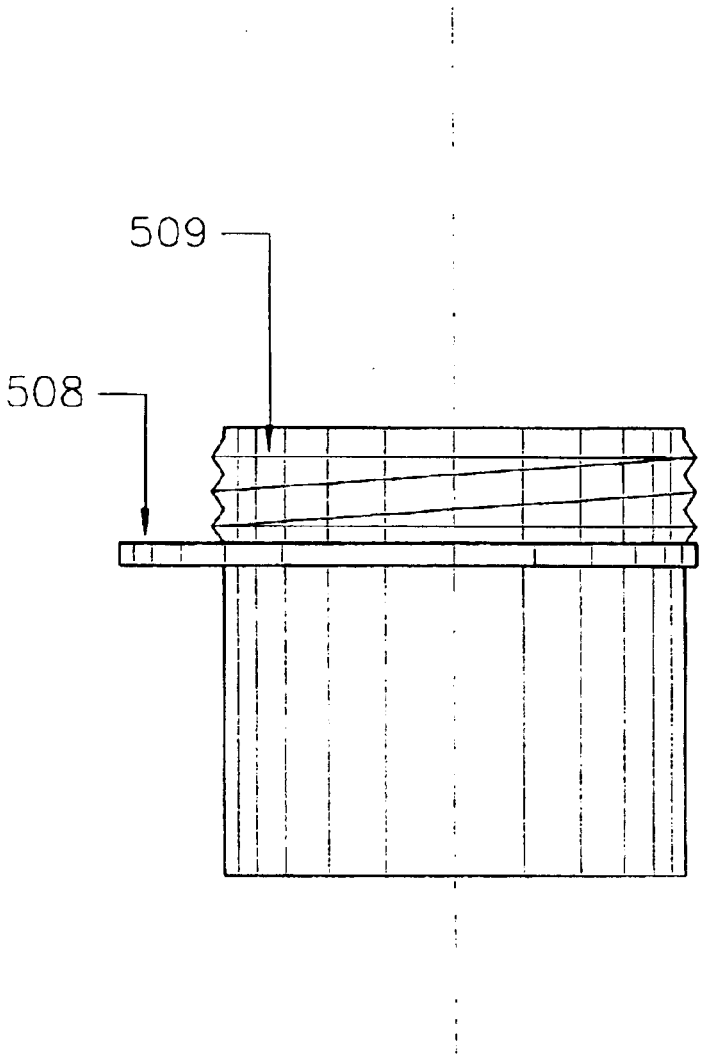
FIG. 5B is a side view of the arm socket of FIG. 5A.

Turning to FIG. 5A, another preferred distributor plate-to-arm connection is described. In this embodiment, an arm socket 500 extends through a larger hole 504 in distributor plate 502. Each of the larger holes is surrounded by at least one smaller hole 506. These smaller holes are used to attach a flange 508 from the arm socket 500 to the distributor plate 502. Specifically, a screw 510 passes through a hole in flange 508 and then through the smaller hole 506 in distributor plate 502.

Figure 5C:
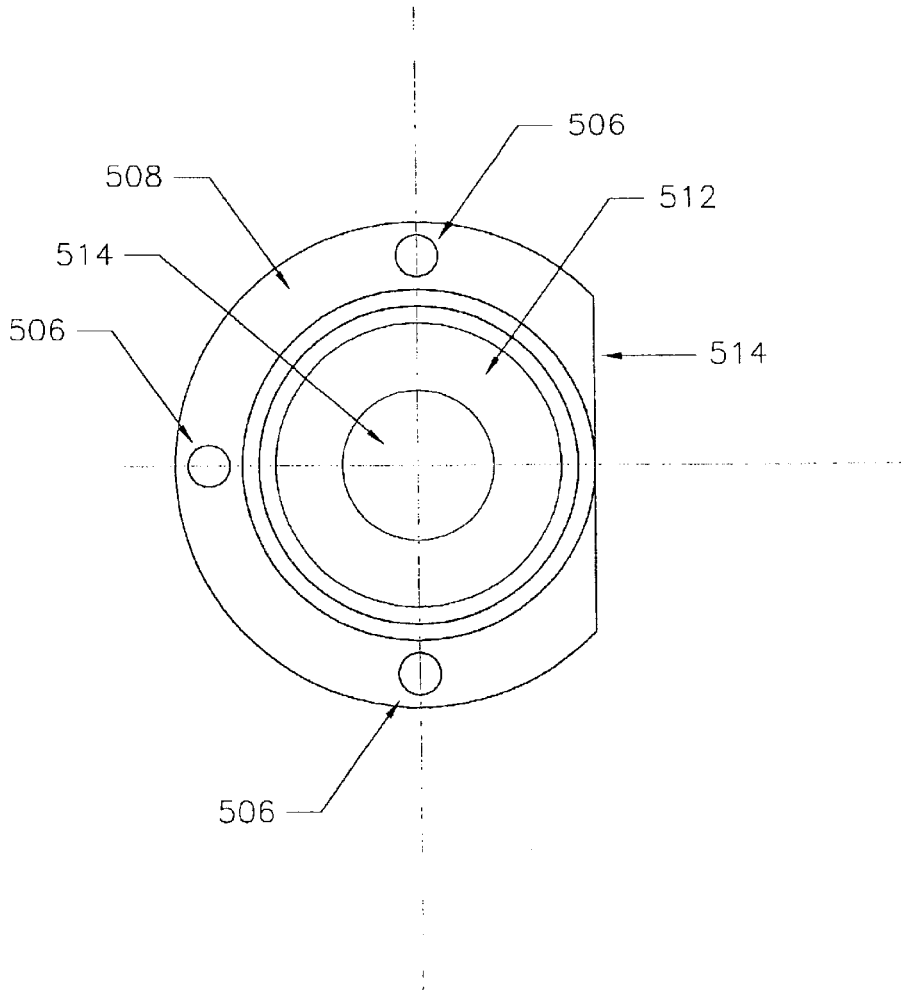
FIG. 5C is a top view of the arm socket of FIG. 5A.

The arm socket 500 is substantially a hollow cylinder with a plate bottom 512. An electric connector 513 in the same design as shown in FIG. 3C is positioned against the plate bottom 512 and the electrical wires pass though a hole 514 (shown in FIG. 5C) in the plate bottom 512. The inner end of an arm terminates in the mating electrical connection.

The exterior portion 509 of the connector 500, above flange 508, is threaded. This is used to join with an arm connection described below in FIGS. 6A and 7A. The flange 508 is notched along one side 514. When the socket 500 is positioned in the hole 504, the side 514 is oriented toward the outer rim of distributor plate 502. Consequently, flange 508 does not extend past the outer rim of disc 502.

Figure 6A:
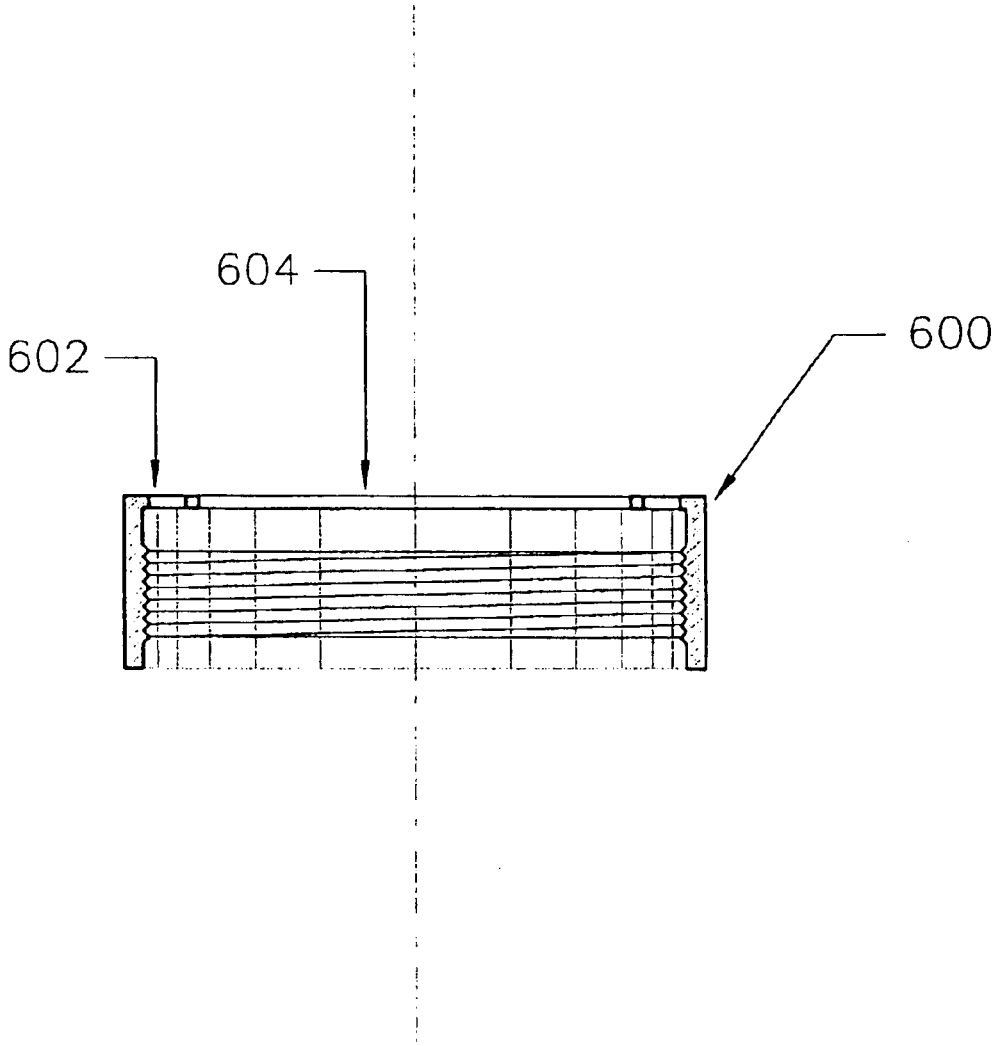
FIG. 6A is a cross-sectional view of a ring used to attach an arm to the arm socket of FIG. 5A.
Figure 6B:
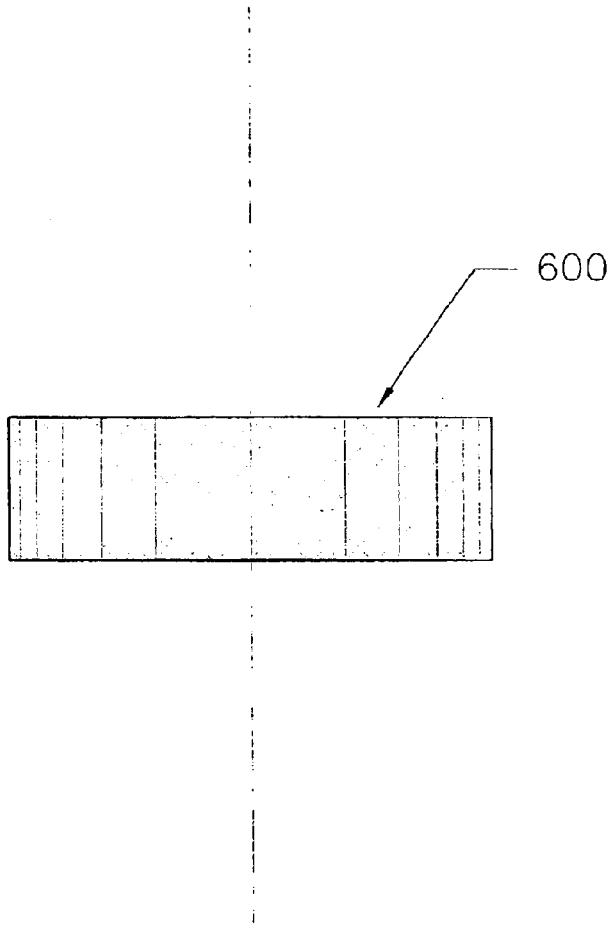
FIG. 6B is a side view of the ring of FIG. 6A.
Figure 6C:
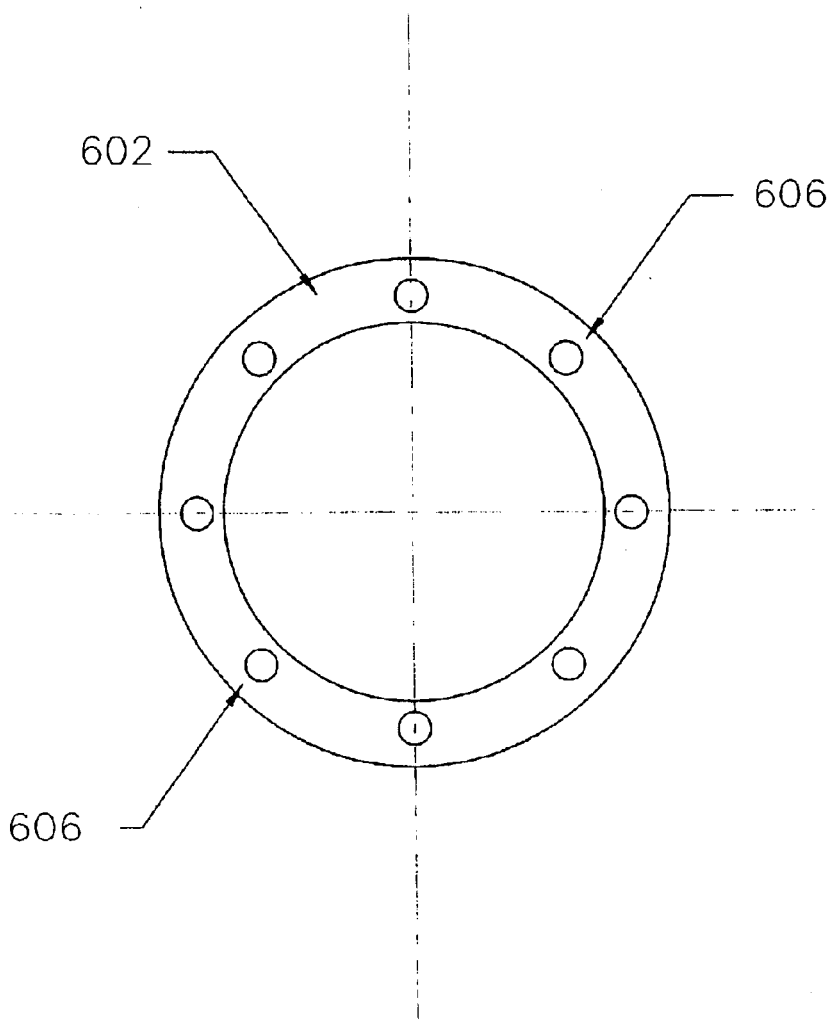
FIG. 6C is a top view of the ring of FIG. 6A.
Figure 7A:
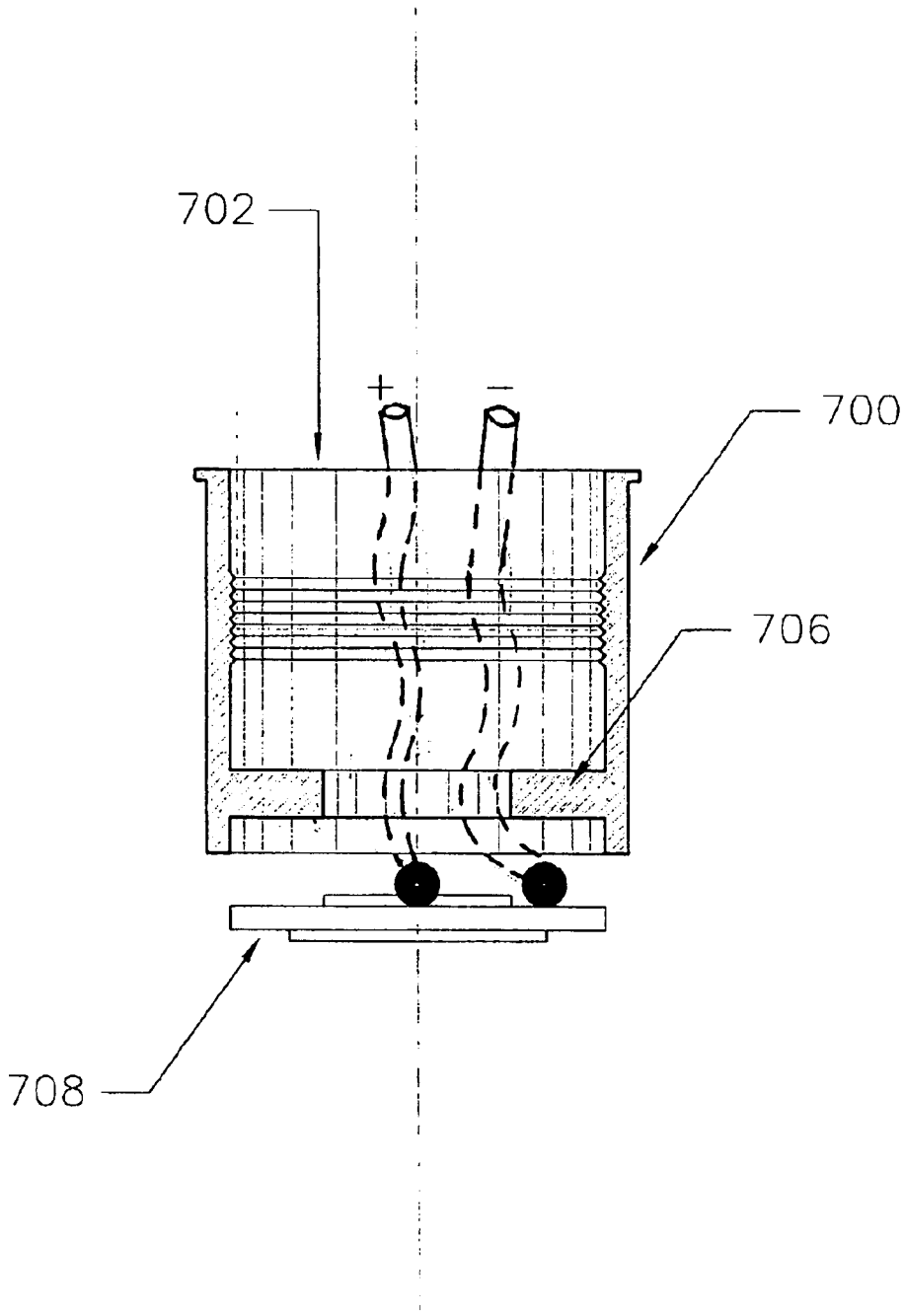
FIG. 7A is a cross-sectional view of an arm termination used to attach an arm to the socket of FIG. 5A.
Figure 7B:
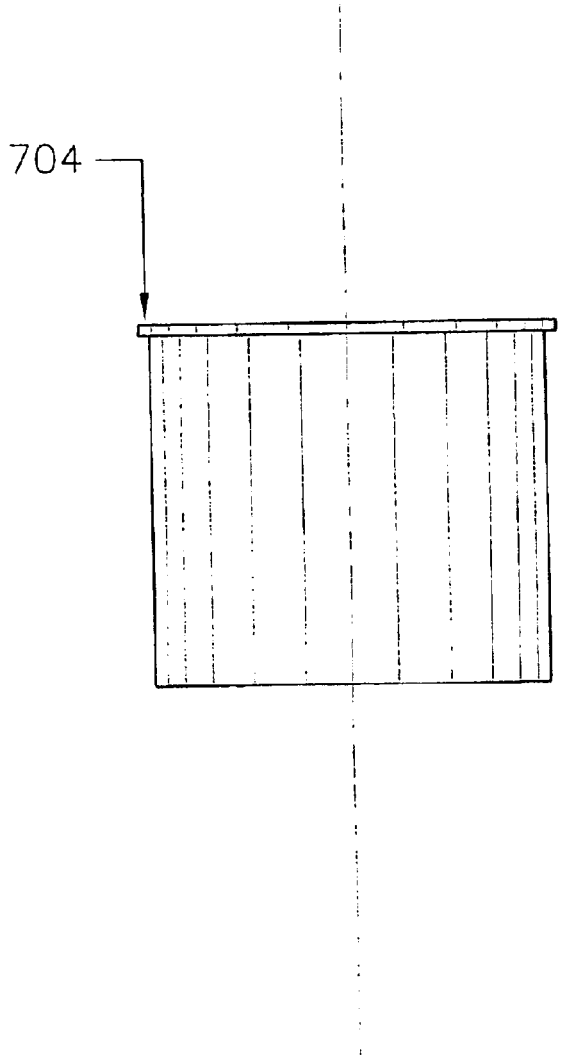
FIG. 7B is a side view of the arm termination of FIG. 7A.
Figure 7C:
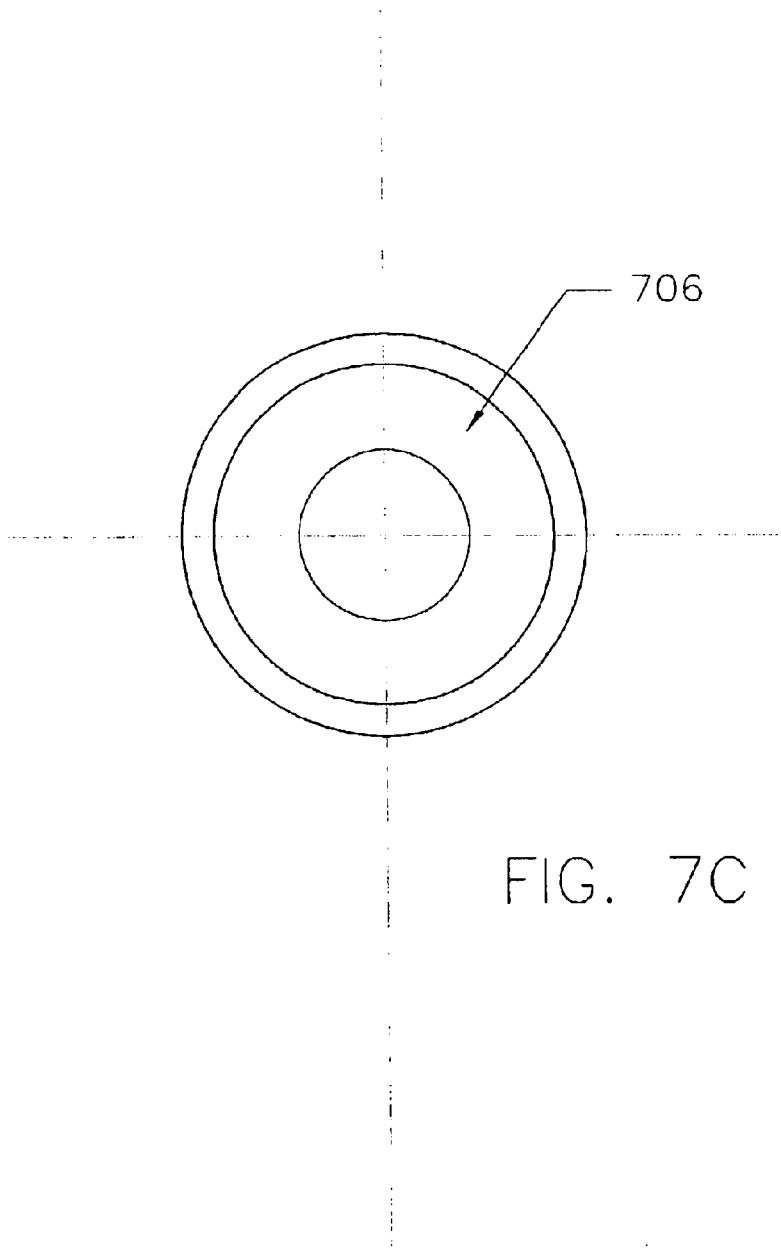
FIG. 7C is a top view of the arm termination of FIG. 7A.

Turning to FIGS. 6A and 7A preferred arm termination parts that are used to mate with arm socket 500 are described. These consist of two principal members, namely a ring 600 and an arm termination 700. A ring 600 is slid up the inner end of a chandelier arm. The interior of ring 600 is threaded to mate with the treads 509. The upper face of the ring 600 defines a plate 602 with a narrowed aperture 604. The arm is sized just to fit within the aperture 604. The top of plate 604 define a plurality of holes 606 about its circumference. These are used to receive the prongs of a tightening tool.

Arm termination 700 is substantially cylindrical. It defines an interior cavity 702 of substantially the same diameter of an arm. The hollow chandelier arm is bonded within the interior cavity so that the arm termination 700 becomes the end of the chandelier arm. Arm termination 700 includes a flared top 704. This flared top 704 is wider than the aperture 604 of the ring 600. To attach an arm to a distributor plate, the arm termination 700 is pushed inside the arm socket 500. The ring 600 slides down the arm and engages the threads 509. As the ring is rotated and tightened, the aperture 604 presses against flare (or rib) 704 so that the arm makes a firm connection with the distributor plate.

The bottom of arm termination 700 also defines an inner plate 706, which in turn defines an interior hole. The mating electrical connector 708 is positioned below the inner plate 706. As the arm is secured, the electrical connector 708 completes a path with electrical connector 513.

Figure 8:
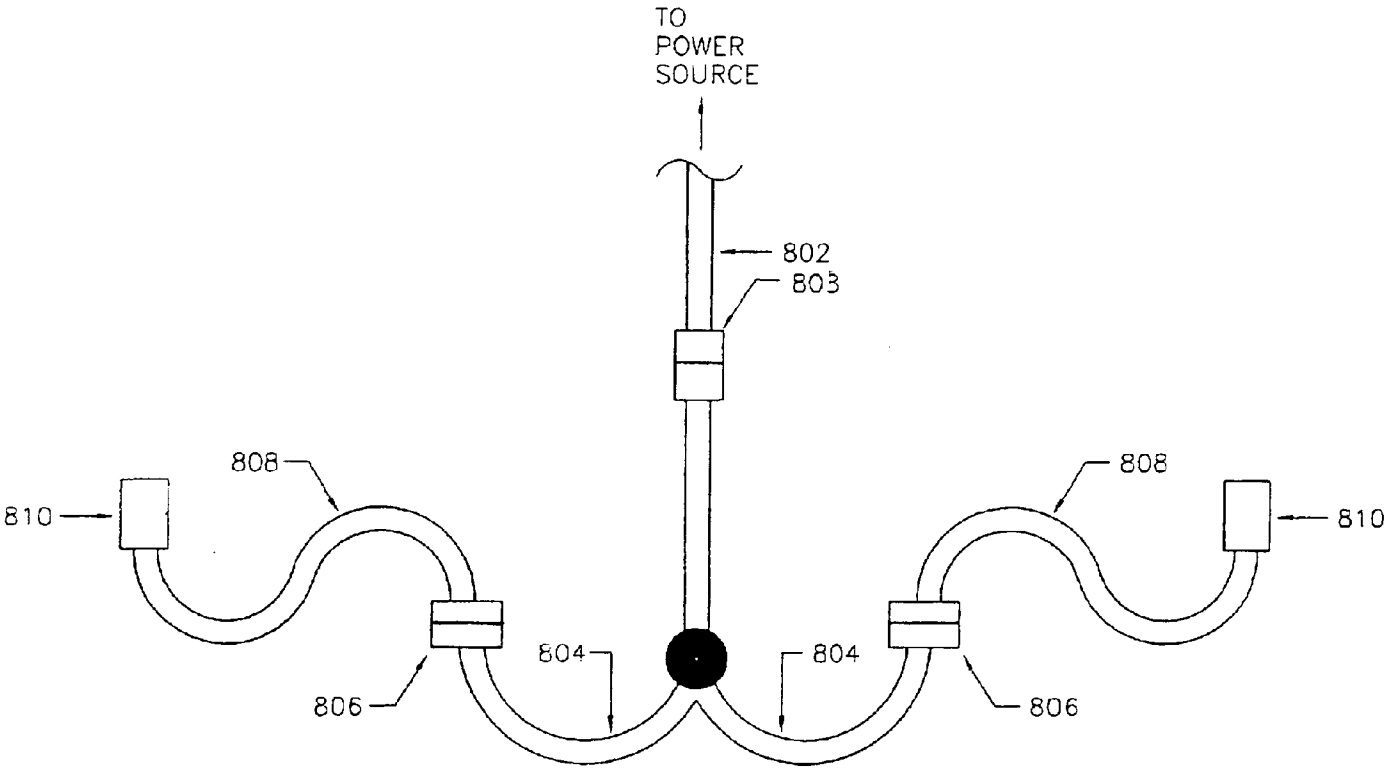
FIG. 8 is a schematic drawing showing the electrical path through a chandelier.

Turning to FIG. 8, one preferred electrical schematic diagram is described. A main pair of electrical wires 802 extends through the body 803 of the chandelier. The main pair of wires 802 pass below the distributor plate and are split into multiple pairs of wires 804 and terminate at an electrical connection 806. The electrical connection 806 is made and broken as an arm is connected and removed, respectively, from a chandelier. Multiple pairs of wires 808 extend through the hollow arms of the chandelier. These terminate in light bulb sockets 810.

Although the invention has been described with reference to specific embodiments, those skilled in the art will appreciate that many modifications and variations are possible without departing from the teachings of the invention. All such modifications and variations are intended to be encompassed within the scope of the following claims.

We claim:

1. A chandelier comprising:

a distributor plate;

a plurality of connections extending through the distributor plate, wherein each of the plurality of connections includes a first pair of electrical terminations;

a plurality of arms each removeably attached to one of the plurality of connections, wherein each of the plurality of arms includes a second pair of electrical terminations, so that when the plurality of arms are attached to the plurality of connections, the second pair of electric terminations of each of the plurality of arms connects with a respective one of the first pair of the electrical terminations of the plurality of connections;

a plurality of pairs of wires each extending through one of the plurality of arms and connecting with a respective one pair of electrical terminations of the plurality of arms; and a plurality of light-bulb sockets each attached to one of the plurality of arms and electrically connected with a respective one of the plurality of pairs of wires;

wherein the plurality of connections each comprise a cylinder extending through the distributor plate, wherein a first end of the cylinder is substantially hollow so that it may receive a respective one of the plurality of arms, and wherein a respective one of the plurality of electrical terminations of the plurality of connections is positioned at the base of the hollow portion of the cylinder, and wherein an exterior end of the cylinder is threaded;

and wherein the plurality of arms each include a circular rib fixedly joined to the arm and a rotatable ring positioned over the circular rib, wherein an interior surface of the rotatable ring is threaded and wherein the rotatable ring defines an inner aperture having a diameter smaller than the circular rib, so that when each of the plurality of arms is positioned in a respective one of the plurality of connections, the threaded interior surface of the rotatable ring engages the threaded exterior end of the cylinder and the inner aperture of the rotatable ring presses against the circular rib.

2. The chandelier of claim 1, wherein the distributor plate comprises a metal disc.

3. The chandelier of claim 2, wherein the plurality of connections are evenly spaced about a perimeter of the metal disc.

4. A chandelier comprising:

a distributor plate composed of a metal disc having a perimeter;

a plurality of connections extending through the distributor plate, wherein each of the plurality of connections includes a first pair of electrical terminations, and wherein the plurality of connections each define a circular flange extending there from to join each of the plurality of connections to the metal disc, and wherein one side of the circular flange is notched so that when the plurality of connections are positioned about the perimeter of the metal disc, the notch is positioned nearest the circumference of the metal disc so that the circular flange does not extend past the metal disc;

a plurality of arms each removeably attached to one of the plurality of connections, wherein each of the plurality of arms includes a second pair of electrical terminations, so that when the plurality of arms are attached to the plurality of connections, the second pair of electric terminations of each of the plurality of arms connects with a respective one of the first pair of the electrical terminations of the plurality of connections;

a plurality of pairs of wires each extending through one of the plurality of arms and connecting with a respective one pair of electrical terminations of the plurality of arms; and a plurality of light-bulb sockets each attached to one of the plurality of arms and electrically connected with a respective one of the plurality of pairs of wires.

5. The chandelier of claim 1, wherein an exterior of the rotatable ring defines a plurality of holes evenly distributed about its circumference to receive a pair of tool prongs used to tighten the engagement of the rotatable ring with the threaded exterior end of the cylinder.

6. The chandelier of claim 1, wherein each of the pair of electrical terminations of the plurality of connections include an insulator disc with a first terminal substantially centered on the insulator disc and a second circular terminal substantially concentric with the insulator disc.

7. The chandelier of claim 6, wherein each of the pair of electrical terminations of the plurality of arms comprise a first and a second prong spaced to match the radial distance between the first terminal and second circular terminal.

8. A chandelier comprising:

a distributor plate;

a plurality of connections extending through the distributor plate, wherein each of the plurality of connections includes a first pair of electrical terminations;

a plurality of arms each removeably attached to one of the plurality of connections, wherein each of the plurality of arms includes a second pair of electrical terminations, so that when the plurality of arms are attached to the plurality of connections, the second pair of electric terminations of each of the plurality of arms connects with a respective one of the first pair of the electrical terminations of the plurality of connections;

a plurality of pairs of wires each extending through one of the plurality of arms and connecting with a respective one pair of electrical terminations of the plurality of arms; and a plurality of light-bulb sockets each attached to one of the plurality of arms and electrically connected with a respective one of the plurality of pairs of wires; wherein:

the distributor plate comprises a metal disc;

the plurality of connections are evenly spaced about a perimeter of the metal disc and each of the plurality of connections define a circular flange extending there from to join each of the plurality of connections to the metal disc, and wherein one side of the circular flange is notched so that when the plurality of connections are positioned about the perimeter of the metal disc, the notch is positioned nearest the circumference of the metal disc so that the circular flange does not extend past the metal disc, and wherein the plurality of connections each comprise a cylinder extending through the base, wherein a first end of the cylinder is substantially hollow so that it may receive a respective one of the plurality of arms, and wherein a respective one of the plurality of electrical terminations of the plurality of connections is positioned at the base of the hollow portion of the cylinder, and wherein an exterior end of the cylinder is threaded, and wherein each of the pair of electrical terminations of the plurality of connections include an insulator disc with a first terminal substantially centered on the insulator disc and a second circular terminal substantially concentric with the insulator disc; and the plurality of arms each include a circular rib fixedly joined to the arm and a rotatable ring positioned over the circular rib, wherein an interior surface of the rotatable ring is threaded and wherein the rotatable ring defines an inner aperture having a diameter smaller than the circular rib, so that when each of the plurality of arms is positioned in a respective one of the plurality of connections, the threaded interior surface of the rotatable ring engages the threaded exterior end of the cylinder and the inner aperture of the rotatable ring presses against the circular rib, and wherein each of the pair of electrical terminations of the plurality of arms comprise a first and a second prong spaced to match the radial distance between the first terminal and second circular terminal.

9. A chandelier comprising:

a distributor plate;

a plurality of connections extending through the distributor plate, wherein each of the plurality of connections includes a first pair of electrical terminations;

a plurality of arms each removeably attached to one of the plurality of connections, wherein each of the plurality of arms includes a second pair of electrical terminations, so that when the plurality of arms are attached to the plurality of connections, the second pair of electric terminations of each of the plurality of arms connects with a respective one of the first pair of the electrical terminations of the plurality of connections;

a plurality of pairs of wires each extending through one of the plurality of arms and connecting with a respective one pair of electrical terminations of the plurality of arms; and a plurality of light-bulb sockets each attached to one of the plurality of arms and electrically connected with a respective one of the plurality of pairs of wires; wherein each of the plurality of connections comprises a cylinder extending from the distributor plate, and wherein each of the plurality of arms comprises a hollow cavity configured to receive the cylinder and a set screw configured to attach the plurality of arms to the plurality of connections.

10. A chandelier comprising:

a central support member extending substantially from a top to a bottom of the chandelier;

a first plate attached to and supported by the central member;

a first plurality of sockets attached to the first plate, wherein each of the first plurality of sockets includes a first electrical connection and wherein each of the first plurality of sockets includes a circular flange extending therefrom to join each of the first plurality of sockets to the first plate;

a first plurality of arms each having second electrical connection, wherein each one of the first plurality of arms is removeably attached to a respective one of the first plurality of sockets so that when the first plurality of arms are attached to the first plurality of sockets the second electrical connections of the first plurality of arms complete an electrical path with the first electrical connections of the first plurality of sockets and so that when the first plurality of arms are removed from the first plurality of sockets the second electrical connections of the first plurality of arms breaks the electrical path with the first electrical connections of the first plurality of sockets.

11. The chandelier of claim 10, wherein the central support member comprises an upper chain connected with a lower tube and wherein the lower tube attaches to the center of the first plate.

12. The chandelier of claim 10, wherein the first plate comprises a metal disc.

13. The chandelier of claim 10, wherein the first plurality of sockets each comprise a cylinder extending through the first plate and wherein at least a portion of the cylinder defines a chamber suitable to receive an end of one of the first plurality of arms.

14. The chandelier of claim 10, wherein the electrical connections of the first plurality of sockets each include a first insulator disc and a first and a second terminal, the first terminal positioned at the center of the first insulator disc and the second terminal extending along a radial path of the first insulator disc.

15. The chandelier of claim 14, wherein the electrical connections of the first plurality of arms each include a second insulator disc and a third and a fourth terminal, the third terminal positioned at the center of the second insulator disc and the fourth terminal extending along a radial path of the second insulator disc having substantially the same circumference as the radial path of the second terminal.

16. The chandelier of claim 10, further comprising a first plurality of light bulb sockets each one attached to one of the plurality of arms and electrically connected with a respective one of the electrical connections of the plurality of arms.

17. The chandelier of claim 10, wherein the central support member comprises an upper chain connected with a lower tube and wherein the lower tube attaches to the center of the first plate;

the first plate comprises a metal disc;

the electrical connections of the first plurality of sockets each include a first insulator disc and a first and a second terminal, the first terminal positioned at the center of the first insulator disc and the second terminal extending along a radial path of the first insulator disc; and the electrical connections of the first plurality of arms each include a second insulator disc and a third and a fourth terminal, the third terminal positioned at the center of the second insulator disc and the fourth terminal extending along a radial path of the second insulator disc having substantially the same circumference as the radial path of the second terminal.

18. The chandelier of claim 10, further comprising:

a second plate attached to and supported by the central member below the first plate;

a second plurality of sockets attached to the second plate, wherein each of the second plurality of sockets includes a third electrical connection;

a second plurality of arms each having a fourth electrical connection, wherein each one of the second plurality of arms is removeably attached to a respective one of the second plurality of sockets so that when the second plurality of arms are attached to the second plurality of sockets the fourth electrical connections of the second plurality of arms complete an electrical path with the third electrical connections of the second plurality of sockets and so that when the second plurality of arms are removed from the second plurality of sockets the fourth electrical connections of the second plurality of arms breaks the electrical path with the third electrical connections of the second plurality of sockets.

* * * * *